United States Patent [19]

Konstantin

[11] Patent Number: 4,514,966

[45] Date of Patent: May 7, 1985

[54] SHRINK BANDING MACHINE FOR USE WITH THIN FILM

[76] Inventor: Anatole E. Konstantin, 10 Live Oak Rd., Norwalk, Conn. 06851

[21] Appl. No.: 446,223

[22] Filed: Dec. 2, 1982

[51] Int. Cl.[3] ..... B65B 13/16; B65B 7/28; B65B 5/00

[52] U.S. Cl. ..... 53/585; 53/291; 53/557

[58] Field of Search ..... 53/557, 585, 567, 556, 53/291, 49

[56] References Cited

U.S. PATENT DOCUMENTS

| | | | |
|---|---|---|---|
| 2,623,673 | 12/1952 | Holstein | 226/80 |
| 3,903,677 | 9/1975 | Bowman | 53/384 |
| 3,924,387 | 12/1975 | Konstantin | 53/291 |
| 3,974,628 | 8/1976 | Konstantin | 53/291 |
| 4,118,916 | 10/1978 | Sleever | 53/292 |
| 4,387,553 | 6/1983 | Strub et al. | 53/585 |

FOREIGN PATENT DOCUMENTS

| | | |
|---|---|---|
| 2206734 | 6/1974 | France . |
| 2355719 | 1/1978 | France . |

*Primary Examiner*—W. D. Bray

[57] ABSTRACT

Banding apparatus is made capable of using thin plastic shrink tubing by being provided with a plurality of mechanical fingers that hold each band as it is cut from the tubing and thereafter shape the band into a polygonal or a circular configuration before the band is pushed off the fingers and over the article to be banded.

3 Claims, 14 Drawing Figures

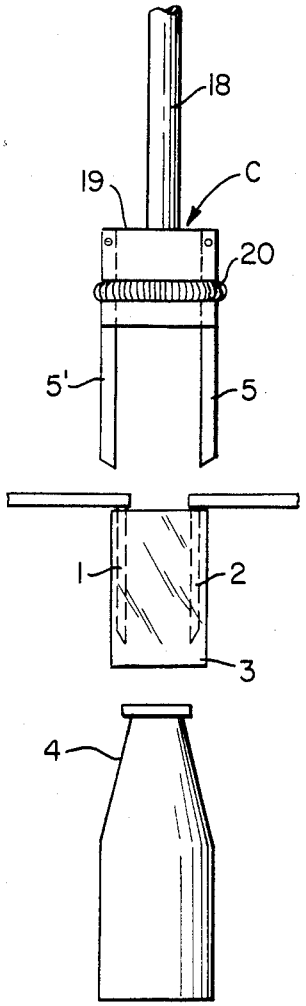
FIG. 3
FIG. 4
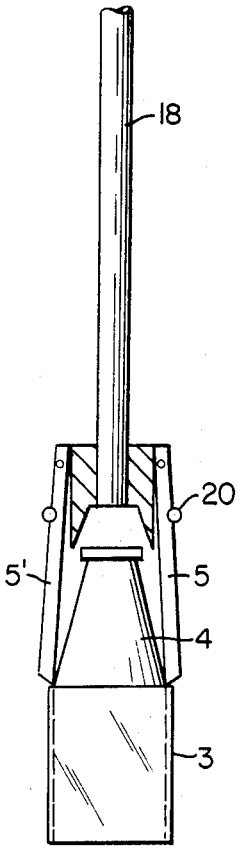

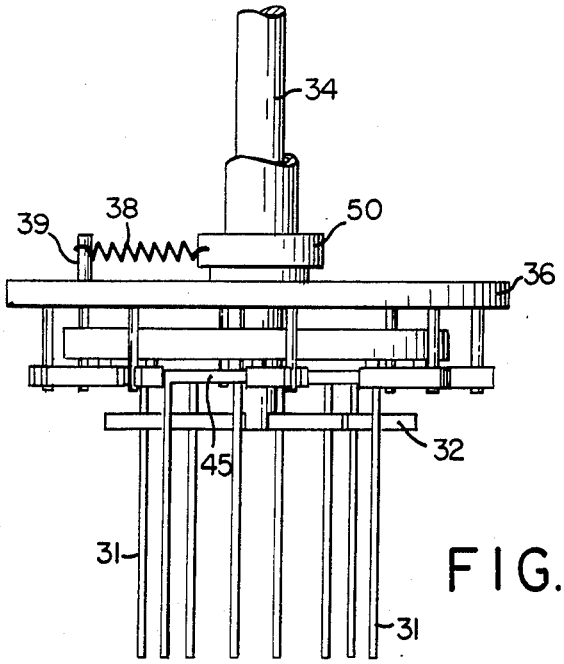
FIG. 13
FIG. 14
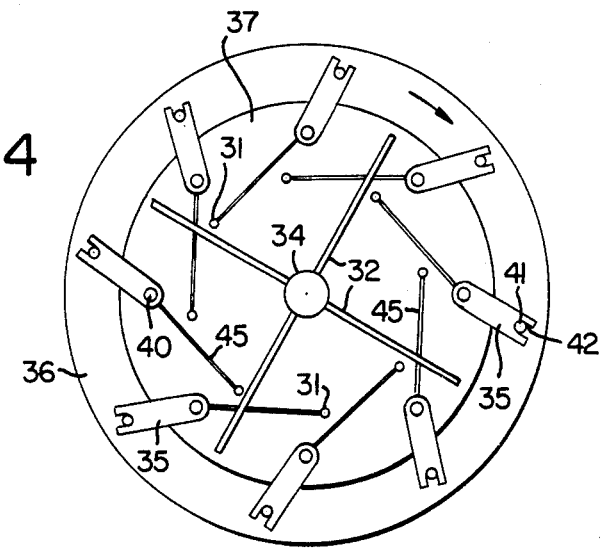

SHRINK BANDING MACHINE FOR USE WITH THIN FILM

TECHNICAL FIELD

This invention relates to apparatus for cutting bands from tubing made of shrinkable plastic film and for placing the bands around containers such as bottles, jars, cans and tubs, as well as around or over other articles to be banded by the shrinkable film.

BACKGROUND OF THE INVENTION

Although apparatus for banding articles with shrinkable plastic film is known in the art, as shown for example in my U.S. Pat. No. 3,924,387, such apparatus is suitable for handling only plastic bands that have sufficient resiliency to remain open when compressed slightly at their crimped edges, and that have sufficient structural strength to be pushed over the article to be banded without collapsing.

Bands made of plastic film thinner than about 2.0 mills have insufficient structural strength or resiliency to be usable in apparatus such as that described in the above mentioned patent. Even thicker walled bands, i.e. those made of plastic film 3.0 mills thick, may not work well if the band is short relative to its diameter; for example if the ratio of the length of the band to its diameter is less than about 1 to 3. Moreover, thin walled tubing also causes problems because of its tendency to stick together when it becomes statically charged.

One attempt to solve the above problem is disclosed in my U.S. Pat. No. 3,974,628, wherein means are described for grasping the bands and placing them over articles to be banded. The means comprise a plurality of parallel fingers capable of linear motion in the axial direction and of lateral motion. The linear motion enables the fingers to enter into and to be retracted from the band. The lateral motion enables the fingers to assume a contracted position, which permits them to enter the band when it is substantially closed, and to assume an expanded position which opens the band into a rectangular or octagonal configuration. The apparatus disclosed in U.S. Pat. No. 3,974,628, while useful for placing thin filmed bands over rectangular objects, is not useful for placing such bands onto bottles, cans, tubs or cylindrical objects because it is not capable of opening the bands into a circular configuration, not even into a square configuration larger than the fixed distance between a set of fingers. The distance is fixed by the fact that the fingers must fit inside the partially closed band.

While squared bands may be slipped over bottles that have a smoothly-contoured, gradually-narrowing neck, a band must be formed into a circular configuration if it is to fit easily over flat-topped objects such as cans and jars. Even squared bands of minimum diameter will not fit over flat-topped containers, since the bands cannot be stretched without breaking. Consequently, to use bands of minimal diameter makes it necessary to form the bands into circular configurations before they can be placed around flat-topped cylindrical articles to be banded. The usefulness of the apparatus shown in U.S. Pat. No. 3,974,628 is limited by the fact that the mechanical fingers are, as a consequence of their design, a fixed distance from each other, and also by the fact that the arms to which the fingers are attached can only move in a linear (axial) direction. Hence, the fingers of said machine are unable to be slipped inside of very narrowly opened bands, and cannot be used for forming the bands into circular configurations. In view of these limitations, the banding machines of the prior art have limited utility for banding articles with shrinkable plastic bands made of thin film.

OBJECTS OF THE INVENTION

It is an object of this invention to provide apparatus capable of rapidly placing bands of thin, shrinkable, plastic film about articles such as bottles, flat-topped containers and the like.

It is an other object of this invention to provide apparatus capable of opening bands of thin, shrinkable, plastic film and forming them into square or circular configurations prior to being placed telescopically about one or more articles to be banded.

SUMMARY OF THE INVENTION

The above and other objects, which will be apparent to those skilled in the art, are achieved by the present invention, one embodiment of which comprises:

apparatus for placing a band of thin, shrinkable, plastic film over an article to be banded, comprising in combination;

(a) means for feeding a specified length of thin, shrinkable, plastic tubing flattened in a first plane, (b) means for opening the flattened tubing and for refolding it in a second plane perpendicular to the first plane, (c) means for feeding the specified length of refolded tubing into position for being cut, (d) means for cutting the specified length of refolded tubing into a band, (e) means for conveying articles to be banded in timed sequence with said cut bands to a banding position, and after being banded to a heating tunnel to shrink fit the band tightly around the article, said apparatus including and being characterized by:

(f) means for opening and holding the band on being cut from the tubing, and for forming the band into a square configuration, said means comprising two sets of parallel fingers, each set containing at least two fingers adapted to move in arcuate paths in the plane perpendicular to the axes of the fingers from a contracted position to an expanded polygonal position, thereby enabling the tubing to be slipped over the contracted fingers before the band is cut from the tubing, and enabling the fingers to expand against the inside surface of the band with sufficient force to open the band fully into a polygonal shape and to hold the band on the expanded fingers after it has been cut, and (g) means for pushing the band off the expanded fingers and over the article to be banded.

The expanded position is preferably a square, in which case each set of parallel fingers requires two fingers. However, the expanded position may be any shaped polygon, for example a pentagon or an octagon. In such cases, five and eight fingers are required. Where the polygon has an odd number of sides, such as a pentagon, one set of fingers will have three fingers while the other will have two. To have more than four fingers in a set is mechanically cumbersome, therefor opening the band into a configuration having more than eight sides is impractical.

Another preferred embodiment of the present invention comprises, in addition to the means set forth above:

means for forming said band into a substantially circular configuration, said means comprising a plurality of parallel fingers adapted to move up and down in an axial direction, and in arcuate paths in the plane perpendicular to said axial direction from a contracted tight circular position to an expanded enlarged circular position, thereby enabling said fingers, when in their contracted position, to be extendable into an opened band and therein to expand against the inside surface of the band with sufficient force to hold the band on the extended fingers and to shape the band into a substantially circular configuration.

THE DRAWINGS

FIGS. 3 and 4 are both front views illustrating the manner in which the plunger arms of FIG. 1 strip the band from the squared fingers and push it onto the bottle to be banded.

FIGS. 13 and 14 are the same as FIGS. 11 and 12 except that the fingers are shown in the opened position.

DETAILED DESCRIPTION

Figure 1:
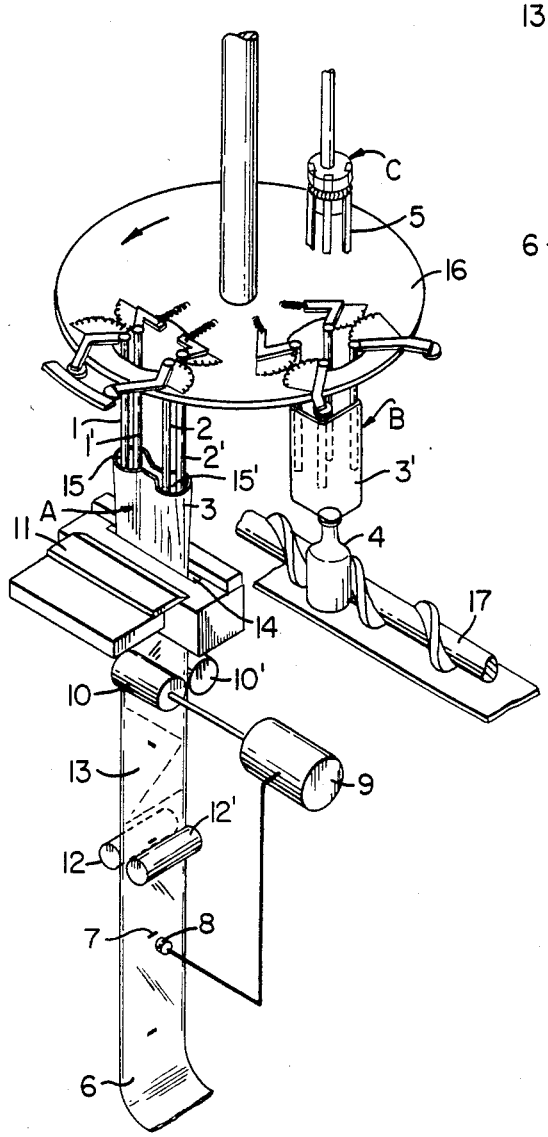
FIG. 1 is a perspective view illustrating the principal operating components of a preferred embodiment of the apparatus of the present invention, wherein the band is formed into a square configuration prior to being placed over a bottle to be banded.

The following detailed description will describe both the principal structural elements of the present invention as well as the manner in which they function. Reference is made to FIG. 1 which illustrates one preferred embodiment of the present invention, i.e. apparatus capable of forming a band of thin, heat-shrinkable plastic film into a square configuration by means of four mechanical fingers 1, 1', 2 and 2' that open the band 3 and place it over the bottle 4 to be banded, after which a set of plunger arms 5 strip the band 3' off the fingers and pushes it over the bottle 4. Bands 3 of plastic tubing 6 are automatically cut from a coiled supply roll of plastic tubing (not shown) by means known in the art.

Plastic shrink tubing 6 is commercially available in various diameters and thicknesses. It may be imprinted, for example, with the trade name of the product, as well as with other pertinent information regarding the product which is to be packaged in the bottle or other container to be banded. The tubing 6 may also have registration marks 7 imprinted on it. These marks may be used to determine the length of tubing which will be cut into bands. As each mark 7 passes in front of photo cell 8, it trips a switch that causes the electric motor 9 to stop momentarily. Since motor 9 drives the tubing feed rollers 10 and 10', whenever a registration mark 7 appears before the photo cell 8, it causes the tubing 6 to stop momentarily, at which time cutter blade 11 is caused to move forward by drive means (not shown), thereby cutting the length of tubing prescribed by the distances between two registrations marks 7, into a band 3.

The flattened tubing 6, after passing between guide rollers 12 and 12' is opened by the tetrahedral wedge 13 which, in combination with driven rollers 10 and 10', causes tubing 6 to be refolded in a plane perpendicular to the plane in which tubing 3 was originally flattened. The refolded tubing, as it extends through the cutting slit 14 will form a "figure 8", i.e. the tubing may be substantially closed in the middle, but will always remain sufficiently open at each end 15 and 15' to enable the tubing to be slid over the two sets of contracted fingers 1, 1' and 2, 2' shown at station A. As band 3 is cut from the tubing by blade 11, the fingers 1, 1' and 2, 2' are caused by timed motive means (not shown) to expand into a square configuration, as shown at station B, and to exert sufficient force against the inside surface of band 3 to hold it firmly. Plate 16 to which each finger assembly is fixedly attached is then rotated 90° in the direction of the arrow by conventional time drive means (not shown) to the banding station B where band 3' is stripped from the fingers by the stripper assembly C (shown in greater detail in FIGS. 3 and 4) and pushed over bottle 4. A driven screw feeder 17 may be used to position bottles in timed sequence under the open square bands at banding station B. After banding, the bottles are conveyed by feeder 17 to a conventional heating tunnel (not shown) to shrink fit the band tightly around the bottle.

Figure 2:
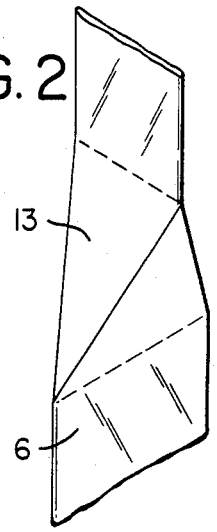
FIG. 2 is an enlarged detail of the wedge shown in FIG. 1 for opening the flattened tubing and for turning the plane in which the tubing is refolded by 90°.

FIG. 2 shows in an enlarged view how the tetrahedral wedge 13 opens the flattened tubing 6 and causes it to become refolded in the plane perpendicular to the plane in which the tubing was originally flattened.

FIGS. 3 and 4 are enlarged views of the stripper assembly C shown in FIG. 1. It consists of driven piston arm 18 to which four stripper arms 5 (only two can be seen) are pivotably attached to plate 19. Each of the arms 5 are pinned to plate 19 so that they may swing outward and open up. As piston arm 18 is moved down, the arms 5 engage the top edge of band 3 and push it down, off fingers 1 and 2, and over the conical neck of bottle 4. A circular spring 20 keeps arms 5 closed around the neck of bottle 4. After band 3 has been pushed down over the bottle, the piston arm 18 and assembly C is retracted.

Figure 5:
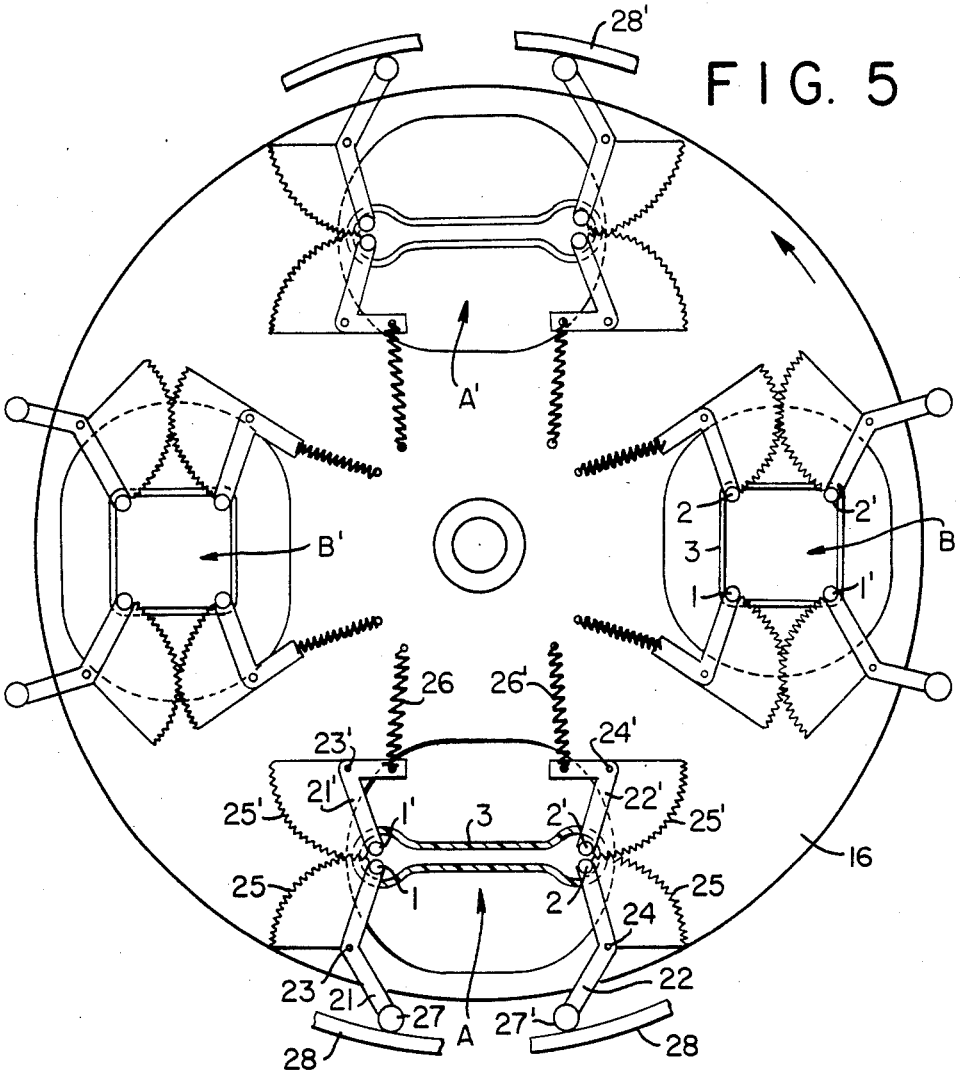
FIGS. 5 and 6 are enlarged top and front views, respectively, illustrating the mechanism of FIG. 1 by which the fingers open the band into a square configuration.
Figure 6:
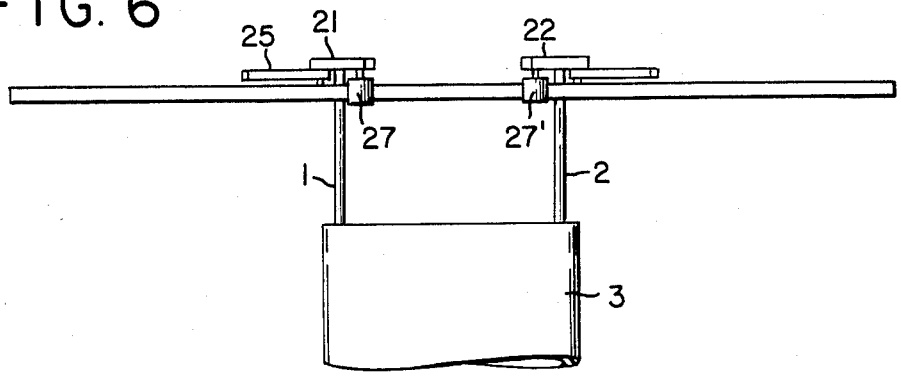

FIGS. 5 and 6 illustrate in greater detail the structural elements of the band opening assemblies and the manner in which they function to open bands 3 into a square configuration. The embodiment illustrated in FIG. 5 is provided with double sets of assemblies and is hence capable of banding two lines of containers simultaneously. This doubles the capacity of the machine. Each set of fingers e.g. 1, 1' and 2, 2' is fixedly attached to a set of angled arms 21 and 22 which are pivotably attached to the rotatable plate 16 by pivot pins 23, 23' and 24, 24'. Each set of arms 21, 21' and 22, 22' is geared together by being fixedly attached to gear sectors 25 and 25' so that each set of arms move in unison. Springs 26 and 26' keep fingers 1, 1' and 2, 2' in an expanded (i.e.

open square) position as shown in positions B and B'. However, the outer ends of arms 21 and 22 are provided with rotating cam followers 27, 27' which, engage rail section 28 and 28' as plate 16 is rotated counterclockwise to the band pick-up positions A and A'. Rails 28 and 28' cause the outer ends of arms 21 and 22 to move toward plate 16 causing fingers 1, 1' and 2, 2' to move in arcuate paths to their contracted positions as shown in positions A and A'. As soon as the cam followers 27 and 27' move off rails 28 and 28', springs 26 and 26' are free to contract, causing the fingers to open again into a square. After a band 3 is pushed off the fingers and onto a bottle at position B (as shown in FIG. 1), rail 28' will cause the fingers to move into the closed again as shown at position A' as plate 16 makes a quarter turn. As previously noted, the double set of mechanisms shown in FIG. 5 (only one set is shown in FIG. 1 for greater clarity) enables two lines of bottles to be banded simultaneously at positions B and B', while bands are simultaneously picked up on the fingers at positions A and A'.

Figure 7:
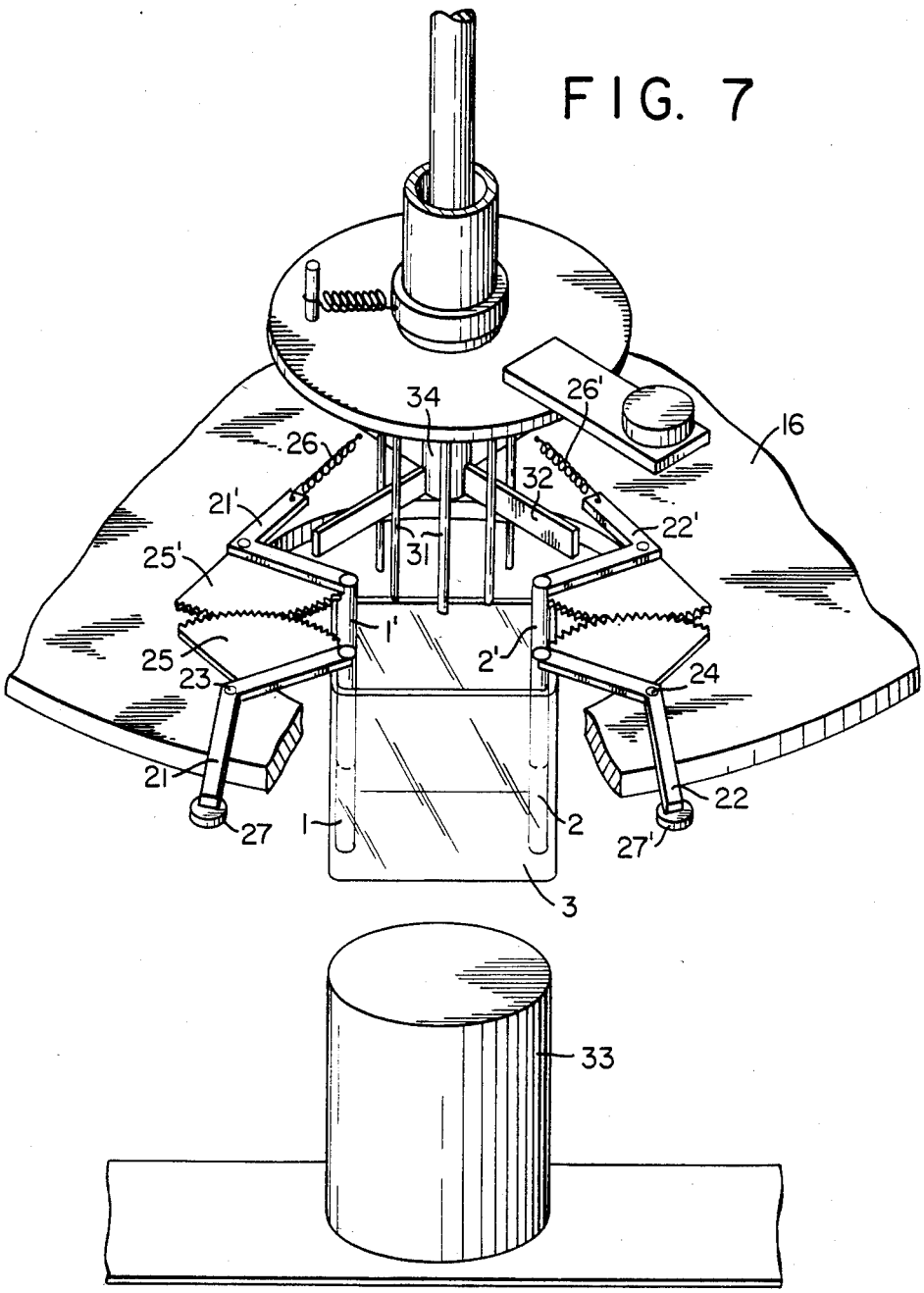
FIG. 7 is a perspective view partially cut away illustrating an other preferred embodiment of the apparatus of the present invention, wherein the band is formed into a circular configuration prior to being placed around a flat-topped container to be banded.

FIG. 7 is a perspective view partially cut away illustrating an other preferred embodiment of the apparatus of the present invention, namely one wherein the band is formed into a substantially circular configuration prior to being placed over a flat-topped container. As can be seen from FIG. 7, band 3 has already been opened into a square configuration by the fingers 1, 1', 2 and 2' by apparatus and in the manner described above. After the band has been opened into a square or other polygonal configuration, a plurality of contracted fingers 31 are extended axially downward into the opened band 3, and once therein, fingers 31 are extended to form a substantially circular configuration as shown stepswise in FIGS. 8, 9 and 10. Band 3 is now held taught on the plurality of extended fingers 31. In other words, fingers 31 pick up band 3 from the squared fingers 1, 1', 2 and 2'. Thereafter, band 3 is pushed by stripping arms 32 off fingers 31 and over can 3.

Figure 8:
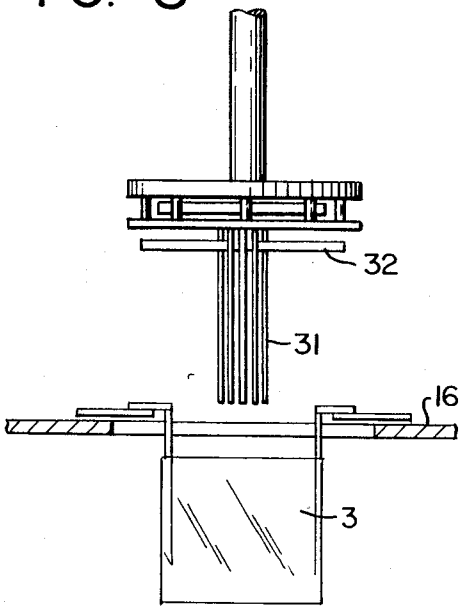
FIGS. 8, 9 and 10 are front views illustrating how the apparatus shown in FIG. 7 functions to shape the squared band into a circular configuration, strip it off the fingers and push the band down over the container to be banded.
Figure 9:
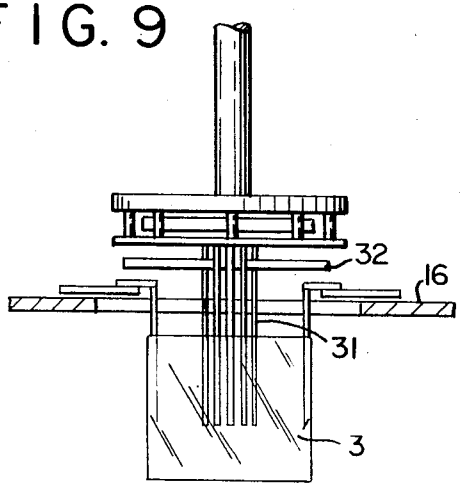
Figure 10:
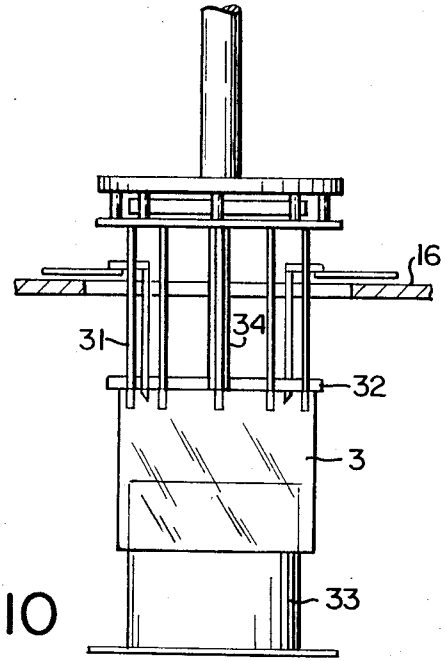

The sequence of operations by which fingers 31 pick up the band from the squared fingers 1 and 2 is shown in greater detail in FIGS. 8, 9 and 10. In FIG. 8 fingers 31 are in their contracted position prior to being extended down inside band 3. In FIG. 9 fingers 31 have been extended down inside of the band and have started to open. In FIG. 10 fingers 31 have opened completely, thereby causing band 3 to be shaped into a substantially circular configuration. At this time, stripping arms 32 are extended downward pushing band 3 off fingers 31 and down over can 33. Stripper arms 32 are attached to shaft 34 (see FIGS. 11 and 12) which functions in timed sequence with the rest of the mechanism. Timing and motive means are conventional throughout the apparatus, and are therefore not shown, being within the skill of the art. In FIG. 10 stripper arms 32 have moved down only partially. In actual operation they could be adjusted to move down until they came in contact with can 33 or just short of the can so that band 3 may either surround the can or overlap the top edge if desired. After the band has been pushed off fingers 31, the stripper arms 32 are retracted and fingers 31 are contracted, ready to enter the next band.

Figure 11:
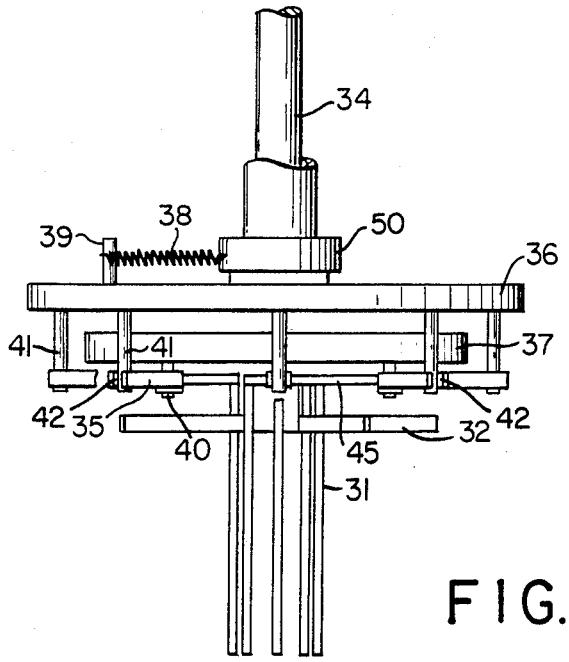
FIGS. 11 and 12 are enlarged front and bottom views, respectively, of the apparatus of FIG. 7 illustrating the mechanism by which the band is formed into a circular configuration by a plurality of parallel fingers shown in the closed position.
Figure 12:
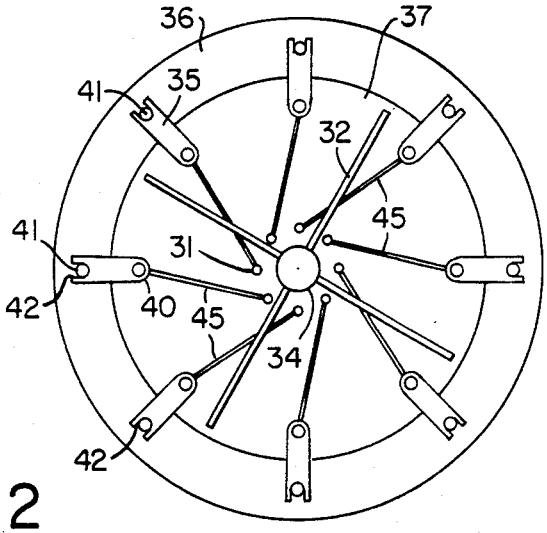

FIGS. 11 and 12 are enlarged front and bottom views, respectively, of the mechanism of FIG. 7 illustrating in greater detail the structure by means of which the band is formed into a circular configuration by fingers 31. In FIGS. 11 and 12, the fingers are shown in their contracted position, while in FIGS. 13 and 14 the fingers are shown in their extended position. Each of the fingers 31, which are "L" shaped, as can be seen most clearly in FIG. 13, are fixedly attached at their upper ends 45 to slotted members 35. Each member 35 is rotatably attached at its inner end to stationary plate 37 by pivot 40, and slideably attached at its slotted end to rotating plate 36 by means of a pin 41 which fits into slot 42. Pin 41 is fixedly attached to plate 36. When plate 36 is rotated clockwise by motive means (not shown) relative to stationary plate 37, each slotted member 35 is caused to rotate about its pivot 40. Rotation of slotted members 35 causes each of the attached fingers 31 to be moved in arcuate paths, similar in motion to a camera shutter, from their contracted position shown in FIGS. 11 and 12 to their extended position shown in FIGS. 13 and 14, respectively. Fingers 31 are kept in the contracted position by means of tension spring 38 which is fixedly attached to pin 39 at one end, pin 39 being fixedly attached to plate 36, while the other end of spring 38 is attached to shaft collar 40.

I claim:

1. Apparatus for placing a band of thin, shrinkable, plastic film over an article to be banded, comprising in combination;

(a) means for feeding a specified length of thin, shrinkable, plastic tubing flattened in a first plane, (b) means for opening the flattened tubing and for refolding it in a second plane perpendicular to the first plane in such manner that the refolded tubing is substantially closed in the middle but open at the ends, (c) means for feeding the specified length of substantially closed refolded tubing into position for being cut, (d) means for cutting the specified length of said refolded into a band, (e) means for conveying articles to be banded in timed sequence with said cut bands to a banding position, and after being banded to a heating tunnel to shrink fit the band tightly around the article, said apparatus being characterized by band opening means capable of entering the open ends of refolded tubing that is substantially closed in the middle as said band is cut from said tubing and opening said band into a polygonal configuration, comprising: two sets of parallel fingers, each set containing at least two fingers and adapted to move in arcuate paths in the plane perpendicular to the axes of the fingers, from a contracted position at the two open ends of the band to an expanded position nearer the center of the band, thereby enabling the open ends of the substantially closed tubing to be slipped over the contracted fingers before the band is cut from the tubing, and enabling the fingers to expand against the inside surface of the band with sufficient force to open the band fully into a polygonal configuration and to hold the band on the expanded fingers.

2. The apparatus of claim 1 wherein each set of fingers contains two fingers and wherein the four fingers form a square in their expanded position.

3. The apparatus of claim 1, which is further characterized by means for forming said band into a substantially circular configuration, said means comprising a plurality of parallel fingers adapted to move up and down in an axial direction, and in arcuate paths in the plane perpendicular to said axial direction from a contracted tight circular position to an expanded enlarged circular position, thereby enabling said fingers, when in their contracted position, to be extendable into an opened band and therein to expand against the inside surface of the band with sufficient force to hold the band on the extended fingers and to shape the band into a substantially circular configuration.

* * * * *